US011020296B2

(12) United States Patent
Burton

(10) Patent No.: US 11,020,296 B2
(45) Date of Patent: Jun. 1, 2021

(54) ATTACHABLE BEDSIDE URINAL HOLDER

(71) Applicant: Val D. Burton, Sanford, MI (US)

(72) Inventor: Val D. Burton, Sanford, MI (US)

( * ) Notice: Subject to any disclaimer, the term of this patent is extended or adjusted under 35 U.S.C. 154(b) by 176 days.

(21) Appl. No.: 15/995,199

(22) Filed: Jun. 1, 2018

(65) Prior Publication Data

US 2018/0353359 A1 Dec. 13, 2018

Related U.S. Application Data

(60) Provisional application No. 62/518,879, filed on Jun. 13, 2017.

(51) Int. Cl.
*A61G 7/05* (2006.01)
*A61G 9/00* (2006.01)

(52) U.S. Cl.
CPC ..... *A61G 7/0503* (2013.01); *A61G 9/006* (2013.01)

(58) Field of Classification Search
CPC .... A61G 7/0503; A61G 9/006; A47C 21/003; F16B 47/00; F16M 13/022
USPC ..... 5/503.1; 248/309.4, 206.5
See application file for complete search history.

(56) References Cited

U.S. PATENT DOCUMENTS 2,600,478 A * 6/1952 Butcher ..... A61G 9/003 4/144.4
3,345,023 A * 10/1967 Scott ..... A61G 7/0503 248/95
3,422,463 A * 1/1969 Lowry ..... A61F 5/44 4/144.1
3,473,772 A * 10/1969 Nilson ..... A61G 7/0503 248/214
3,734,439 A * 5/1973 Wintz ..... B63B 29/12 248/224.51
4,046,295 A * 9/1977 Eichler ..... A45F 5/02 224/242
5,367,278 A * 11/1994 Yoshikawa ..... H01F 7/0268 335/285
5,575,020 A * 11/1996 Hubrig ..... E03D 1/003 4/342
5,626,318 A * 5/1997 Boettger ..... A47K 11/12 248/205.2
6,026,519 A * 2/2000 Kaluza ..... A61G 9/006 4/144.1
6,193,202 B1 2/2001 Rogers
7,398,951 B1 * 7/2008 Sugalski ..... A61G 7/0503 248/214
7,748,583 B1 * 7/2010 Woltman ..... A45D 20/12 224/251

(Continued)

*Primary Examiner* — Nicholas F Polito
*Assistant Examiner* — Luke Hall
(74) *Attorney, Agent, or Firm* — Boudwin Intellectual Property; Daniel Boudwin

(57) ABSTRACT

A urinal holder is provided. The urinal holder comprises a housing having a sidewall and a pair of opposing open ends. The sidewall defines an interior volume, such that the interior volume of the housing slidably receives a handle of a bedside urinal container. A dial is affixed to an outer surface of the housing, wherein the dial rotates the orientation of a longitudinal axis of the housing. A button is disposed on the dial that selectively locks and unlocks rotational movement of the dial. A fastener is disposed on a bottom end of the dial, wherein the fastener secures the dial to a surface. The fastener can be a magnet that secures the attachable bedside urinal holder to a metal surface.

8 Claims, 4 Drawing Sheets

(56) References Cited

U.S. PATENT DOCUMENTS

| | | | | |
|---|---|---|---|---|
| 8,251,266 | B2 * | 8/2012 | Gregory | F41C 33/045 224/198 |
| 8,360,378 | B1 * | 1/2013 | Owens | A63B 57/20 248/309.4 |
| 8,578,528 | B1 * | 11/2013 | Heare | A47C 21/00 5/503.1 |
| 9,164,126 | B1 * | 10/2015 | Rodda | G01R 1/04 |
| 9,797,679 | B2 * | 10/2017 | Ponder | F41C 33/001 |
| 9,931,102 | B1 * | 4/2018 | Studer | A61G 9/006 |
| 2004/0245415 | A1 | 12/2004 | Sun | |
| 2005/0218285 | A1 * | 10/2005 | Yorns | B25H 3/006 248/314 |
| 2006/0196903 | A1 * | 9/2006 | Tanzini | F41C 33/0209 224/200 |
| 2007/0023468 | A1 * | 2/2007 | Ford | F41C 33/045 224/197 |
| 2012/0199715 | A1 * | 8/2012 | Tuell | A61G 9/006 248/311.2 |
| 2014/0246548 | A1 * | 9/2014 | Madsen | F16M 11/10 248/218.4 |
| 2015/0267862 | A1 * | 9/2015 | Mishler | F16M 13/022 248/214 |

* cited by examiner

ATTACHABLE BEDSIDE URINAL HOLDER

CROSS REFERENCE TO RELATED APPLICATION

This application claims the benefit of U.S. Provisional Application No. 62/518,879 filed on Jun. 13, 2017. The above identified patent application is herein incorporated by reference in its entirety to provide continuity of disclosure.

BACKGROUND OF THE INVENTION

The present invention relates to portable urinal containers. More specifically, the present invention provides an attachable bedside urinal holder that removably secures a bedside urinal container to a surface, such as a metal frame of a bedside table.

Portable urinal containers are typically used in a medical setting, such as at a hospital or a nursing home, wherein a patient may be bedridden. In many instances, the portable urinal container is propped upright within a small dish or bowl to prevent spillage. However, many times the portable urinal container may become dislodged from the bowl during use, such that urine is spilled on the floor or bed. In other instances, the urinal container may be left on a bedside table, allowing the container to be easily knocked over. Other urinal containers may be hung from a bedside railing. However, these containers may be difficult to remove or use when secured in place. Therefore, an attachable bedside urinal holder that removably secures to a surface, wherein the holder slidably receives a handle of a bedside urinal container is needed.

Devices have been disclosed in the known art that relate to container holders. These include devices that have been patented and published in patent application publications. These devices generally relate to urinal container holders and cup holder devices. Some of these devices include holders that secure an entire urinal container to the rails of a hospital bed. Some devices include fabric or plastic loops that secure the handle of the container to a bedrail. Another device secures a cup to a surface by utilizing a magnetic fastener. However, these known art devices fail to include a dial that rotates the housing of a urinal holder, such that a bedside urinal container can be locked into various orientations.

In light of the devices disclosed in the known art, it is submitted that the present invention substantially diverges in design elements from the known art and consequently it is clear that there is a need in the art for an improvement to existing urinal holding devices. In this regard the instant invention substantially fulfills these needs.

SUMMARY OF THE INVENTION

In view of the foregoing disadvantages inherent in the known types of urinal holders now present in the known art, the present invention provides a new attachable bedside urinal holder wherein the same can be utilized for providing convenience for the user when securing a bedside urinal container to a surface, such as the metal frame of a bedside table.

It is therefore an object of the present invention to provide a new and improved attachable bedside urinal holder that has all of the advantages of the known art and none of the disadvantages.

It is another object of the present invention to provide an attachable bedside urinal holder comprising a housing having a sidewall and a pair of opposing open ends. The sidewall defines an interior volume, such that the interior volume of the housing slidably receives a handle of a bedside urinal container. A dial is affixed to an outer surface of the housing, wherein the dial rotates the orientation of a longitudinal axis of the housing. A button is disposed on the dial that selectively locks and unlocks rotational movement of the dial. A fastener is disposed on a bottom end of the dial, wherein the fastener secures the dial to a surface. In one embodiment, the fastener is a magnet that secures the attachable bedside urinal holder to a metal surface.

Another object of the present invention is to provide an attachable bedside urinal holder that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
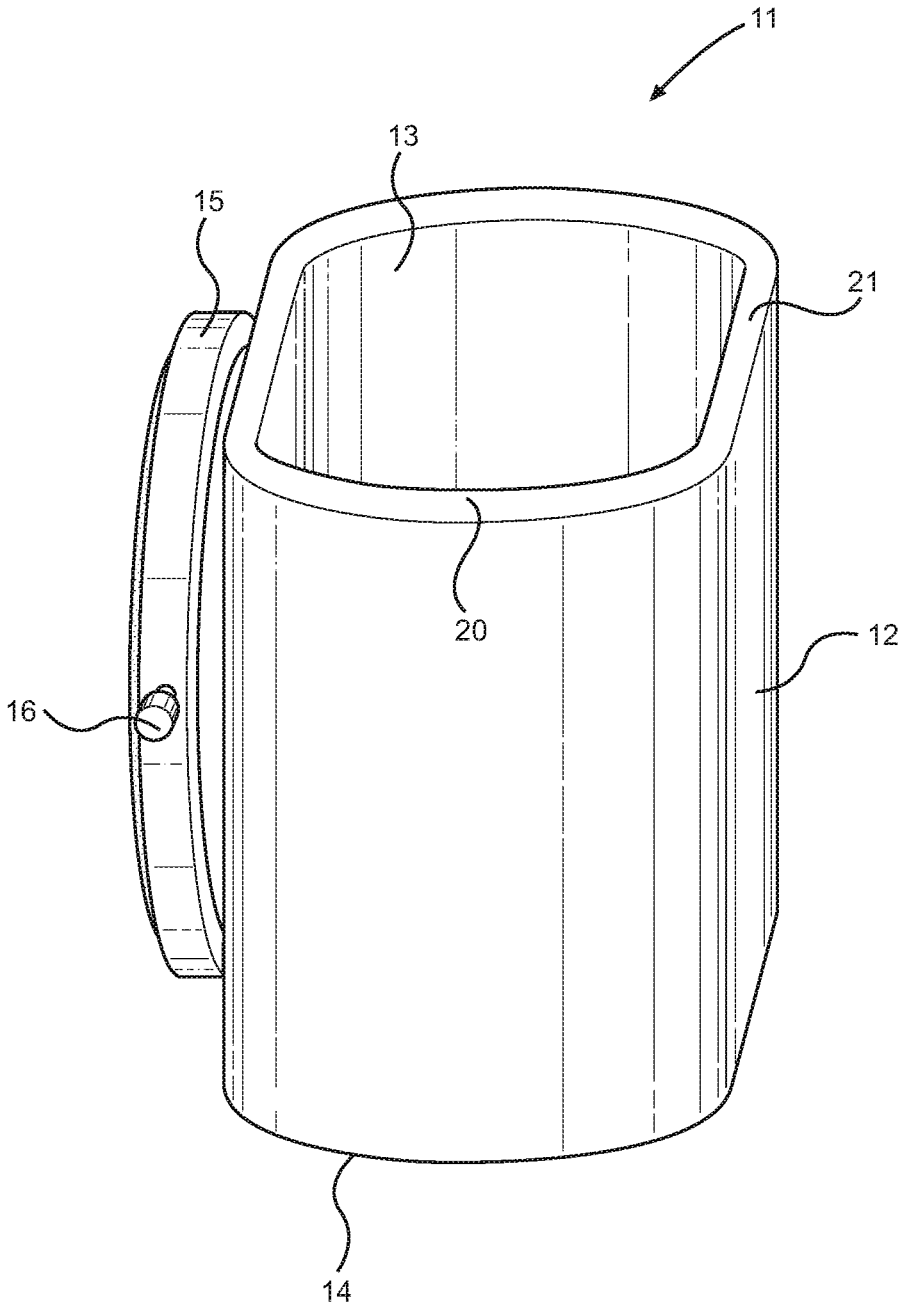
FIG. 1 shows a perspective view of an embodiment of the attachable bedside urinal holder.

Reference is made herein to the attached drawings. Like reference numerals are used throughout the drawings to depict like or similar elements of the attachable bedside urinal holder. For the purposes of presenting a brief and clear description of the present invention, the preferred embodiment will be discussed as used for securing a bedside urinal container to the metal frame of a bedside table. The figures are intended for representative purposes only and should not be considered to be limiting in any respect.

Referring now to FIG. 1, there is shown a perspective view of an embodiment of the attachable bedside urinal holder. The attachable bedside urinal holder 11 comprises a housing 12 having a sidewall and a pair of opposing open ends 13, 14, wherein the sidewall defines an interior volume. The interior volume of the housing 12 is configured to receive a handle of a bedside urinal container. In the illustrated embodiment, the housing 12 comprises a tubular shape with a pair of opposing arcuate side portions 20 and a pair of opposing planar side portions 21. However, any suitable shape that can slidably receive a handle of a bedside urinal container may be used.

In the illustrated embodiment, the pair of opposing planar side portions 21 are configured to rest flush with sides of the handle of the bedside urinal container when received within the housing 12, while the opposing arcuate side portions 20 allow space such that the handle can be easily grasped and removed from the housing 12 when needed. In this way, the opposing planar side portions 21 secure the handle, such that there is little movement of the container when secured within the urinal holder 11, thereby preventing any spillage of urine while in use.

In an alternative embodiment, the housing 12 of the urinal holder 11 is configured to receive the entirety of a urinal container. The housing 12 of the device is constructed of a durable material, such as steel or plastic, configured to maintain the structure of the housing 12 while supporting the weight of a full urinal container. However, any suitable durable material may be used.

The attachable beside urinal holder 11 includes a dial 15 affixed to an outer surface of the housing 12, wherein the dial 15 is configured to rotate the orientation of the housing 12. In the illustrated embodiment, the dial 15 is permanently affixed to the housing 12 and rotates along with the housing 12, as the housing 12 rotates. In alternate embodiments, the dial 15 is rotatably affixed to the housing 12, wherein the dial remains in a fixed position as the housing 12 rotates. The dial includes a button 16 disposed on an outer surface of the dial 16, wherein the button 16 is configured to selectively lock and unlock the rotation of the dial 16. In this way, when the urinal holder 11 is mounted to a surface, the dial 15 is adapted to change the orientation of the longitudinal axis of the housing 12, such that a bedside urinal container received within the housing 12 can be positioned vertically, horizontally, or at an angle in relation to the ground.

Figure 3:
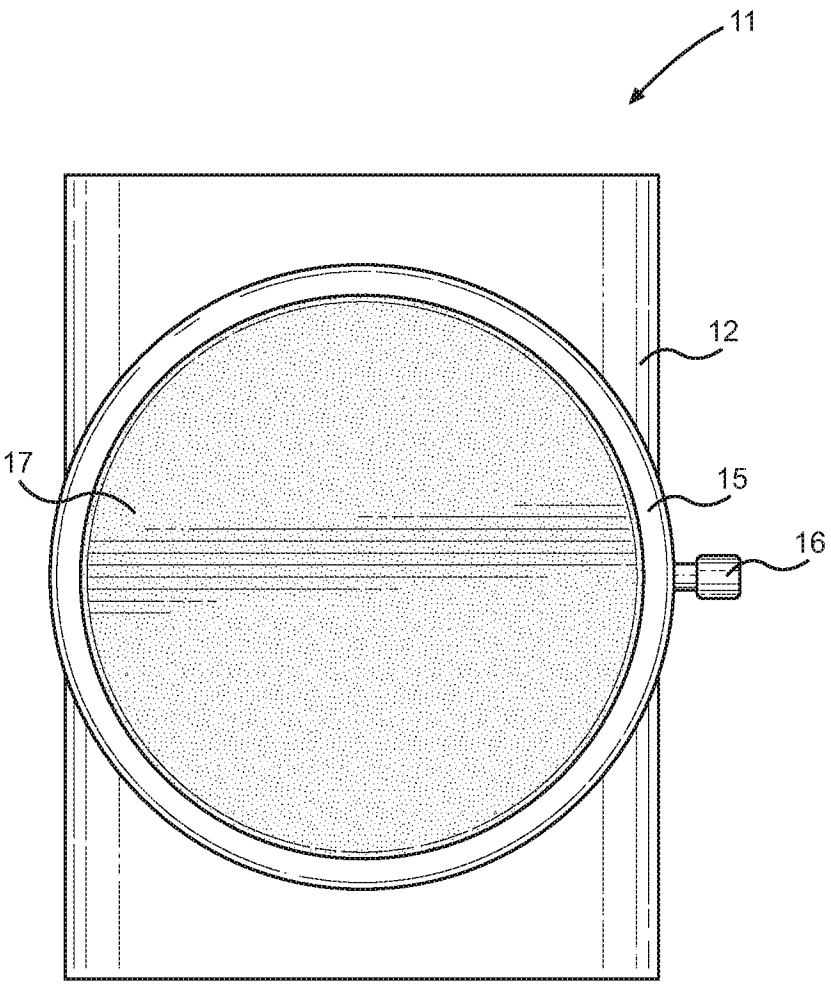
FIG. 3 shows a bottom view of an embodiment of the attachable bedside urinal holder.
Figure 2:
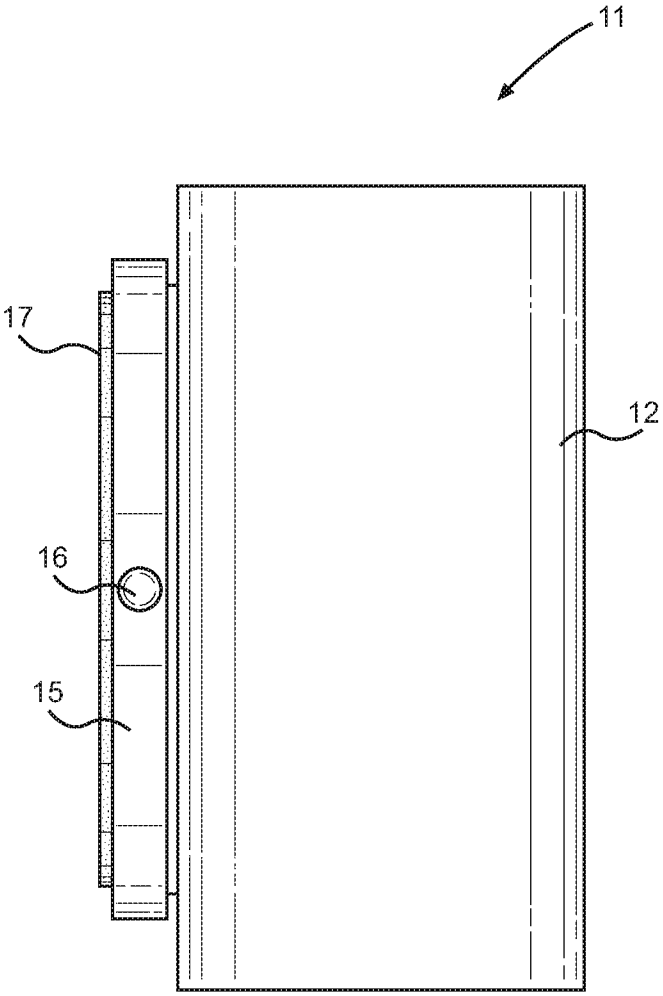
FIG. 2 shows a side view of an embodiment of the attachable bedside urinal holder.

Referring now to FIGS. 2 and 3, there is shown a side view of an embodiment of the attachable bedside urinal holder and a bottom view of an embodiment of the attachable bedside urinal holder, respectively. The attachable bedside urinal holder 11 includes a fastener 17 disposed on a bottom end of the dial 15, wherein the fastener 17 is configured to removably secure the dial 15 to a surface. In the illustrated embodiment, the fastener 17 is a magnet, such that the attachable beside urinal holder 11 can be removably secured to a metallic surface, such as, a steel frame of a bedside table. In this way, the fastener 17 allows the attachable bedside urinal holder 11 to be placed in various locations within a hospital room, such that a urinal container secured within the housing 12 is easily accessed by a user. In alternate embodiments, the entire dial is a magnet.

In the illustrated embodiment, the dial 15 comprises a circular shape. However, in alternative embodiments, the dial 15 may be any suitable shape. The fastener 17 further includes a shape that substantially matches the shape of the dial 15, such as a circular shape as shown. In the illustrated embodiment, the surface area of the magnetic fastener 17 is continuous, such that it is configured to withstand the weight of a fully filled urinal container without dislodging from the surface. However, the magnetic fastener 17 does not exert such force that a user would be unable to manually remove the fastener 17 from the surface. Once the fastener 17 is secured in place, a user can manipulate the orientation of the longitudinal axis of the housing 12 by utilizing the button 16 disposed on the dial 15.

Figure 4A:
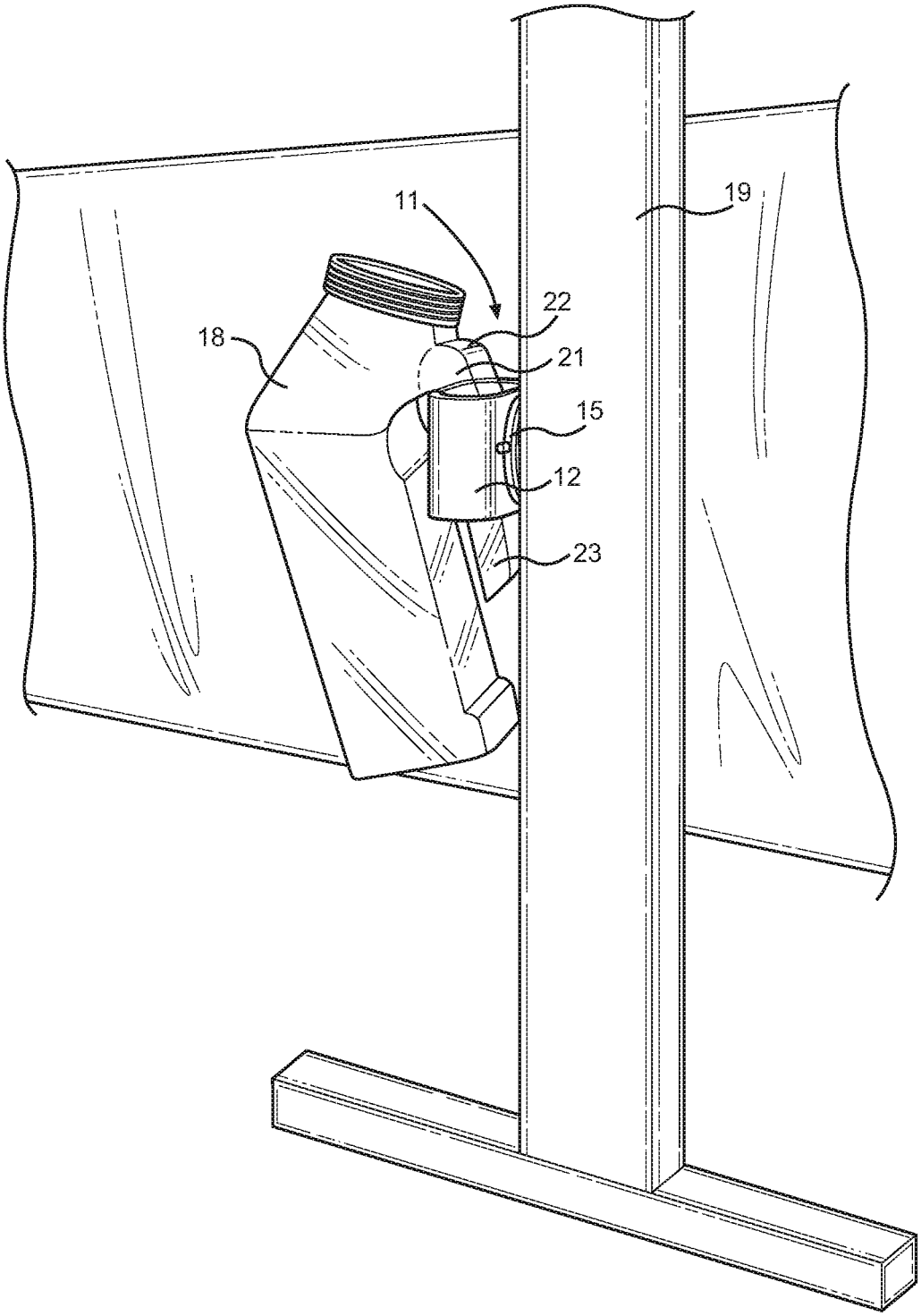
FIG. 4A shows a perspective view of an embodiment of the attachable bedside urinal holder removably secured to a metal frame, wherein a bedside urinal container is in a vertical orientation.
Figure 4B:
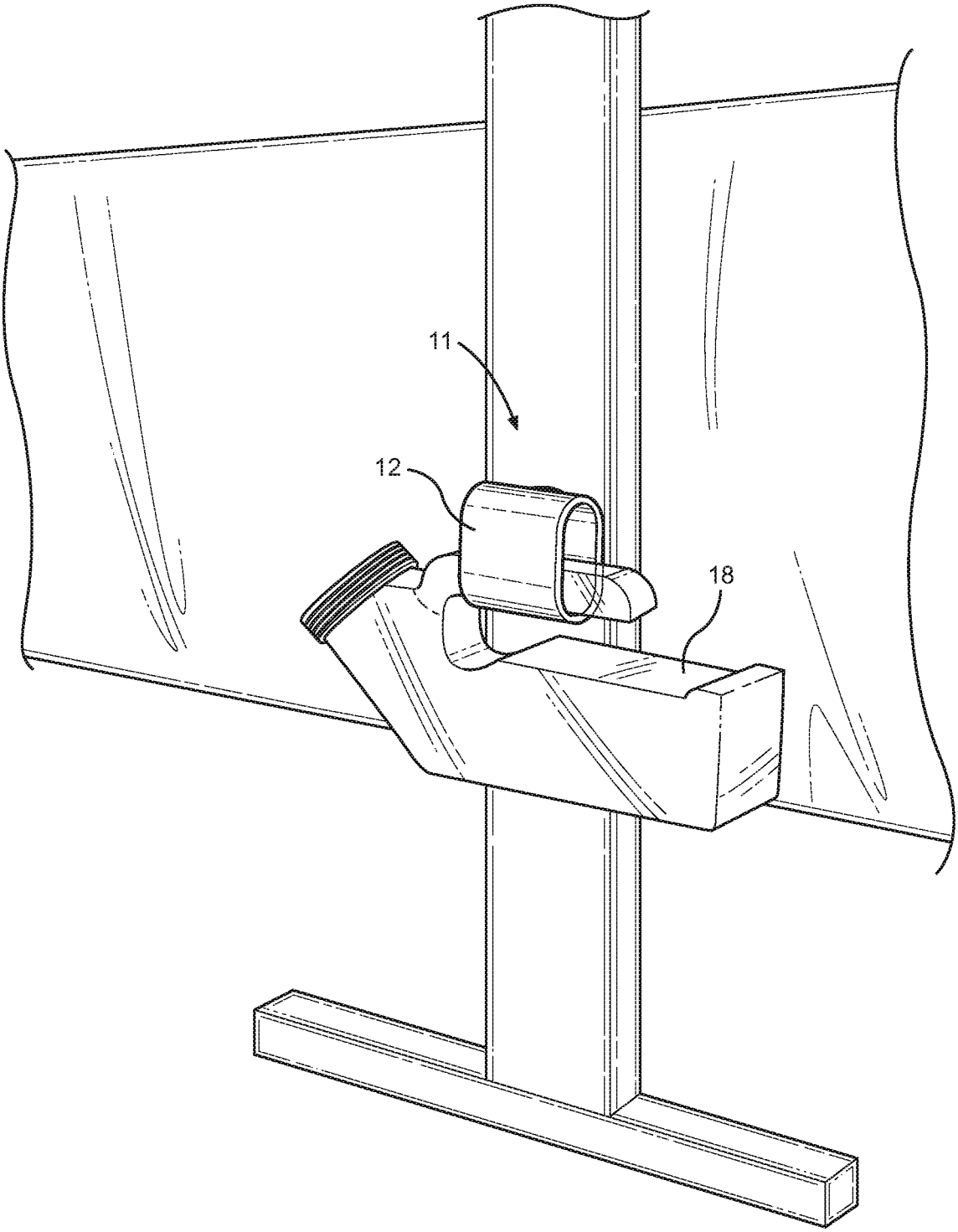
FIG. 4B shows a perspective view of an embodiment of the attachable bedside urinal holder removably secured to a metal frame, wherein a bedside urinal container is in a horizontal orientation.

Referring now to FIGS. 4A and 4B, there are shown a perspective views of an embodiment of the attachable bedside urinal holder removably secured to a metal frame, wherein a bedside urinal container is disposed in a vertical orientation and a horizontal orientation, respectively. In the illustrated embodiment, the attachable bedside urinal holder 11 further comprises a urinal container 18 having a handle 21, wherein the handle includes a proximal end 22 and a distal end 23. The proximal end 22 of the handle 21 is affixed to a surface of the urinal container 18. The distal end 23 of the handle is slidably received within the open end of the housing 12 of the urinal holder 11. In the illustrated embodiment, the handle 21 of the urinal container 18 extends through the housing 12 of the urinal holder 11, such that a joint wherein the proximal end 22 meets the surface of the container 18 rests flush with the open end of the housing 12, such that the housing 12 of the urinal holder 11 supports the weight of the container 18.

In the illustrated embodiment, the magnetic fastener of the attachable bedside urinal holder 11 is affixed to the metal frame 19 of a bedside table. When secured, the dial 15 is rotatable such that the housing 12 of the device 11 can be disposed such that the urinal container 18 can be positioned in a vertical, horizontal, or angled orientation. This allows the urinal container 18 to be disposed in an optimal position, such that it is easily reachable by a user and further prevents spillage of urine from the container 18. In use, the user can lock and unlock the rotation of the dial 15 by selectively actuating the button disposed on the surface thereof.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachable bedside urinal holder, comprising:

a tubular housing having a sidewall and a pair of opposing open ends, wherein the sidewall defines an interior volume, such that the interior volume of the housing is configured to receive a handle of a urinal container;

wherein the tubular housing includes a pair of opposing arcuate side portions and a pair of opposing planar side portions, wherein the pair of opposing planar side portions are configured to rest flush with a pair of sides of a handle of a urinal container;

a dial permanently affixed to an outer surface of the housing, wherein the dial is configured to rotate;

whereupon the dial being rotated, the housing rotates along with the dial;

a button disposed on the dial configured to selectively lock and unlock rotation of the dial;

the button disposed on a side surface of the dial;

a magnet disposed on a bottom end of the dial, wherein the magnet is configured to removably secure the dial to a surface;

wherein the magnet is a shape that substantially matches the shape of the dial; and wherein a surface area of the magnet is continuous.

2. The attachable bedside urinal holder of claim 1, further comprising a urinal container having a handle including a proximal end and a distal end, wherein the proximal end is affixed to a surface of the urinal container and the distal end is slidably received within an open end of the housing of the attachable bedside urinal holder.

3. The attachable bedside urinal holder of claim 2, whereupon the handle of the urinal container fully extends through the housing of the urinal holder, a joint of the proximal end rests flush with the open end of the housing.

4. The attachable bedside urinal holder of claim 1, wherein the dial comprises a circular shape.

5. The attachable bedside urinal holder of claim 1, wherein the housing is constructed of steel.

6. The attachable bedside urinal holder of claim 1, wherein the housing is constructed of plastic.

7. An attachable bedside urinal holder, consisting of:

a urinal container having a handle including a proximal end and a distal end, wherein the proximal end is affixed to a surface of the urinal container and the distal end is slidably received within an open end of a housing of the attachable bedside urinal holder;

the housing having a sidewall and a pair of opposing open ends, wherein the sidewall defines an interior volume, such that the interior volume of the housing is configured to receive the handle of the urinal container;

a dial rotatably affixed to an outer surface of the housing;

wherein the dial remains in a fixed position as the housing is rotated;

a button disposed on the dial configured to selectively lock and unlock rotation of the dial;

the button disposed on a side surface of the dial;

a magnet disposed on a bottom end of the dial, wherein the magnet is configured to removably secure the dial to a surface;

wherein the magnet is a shape that substantially matches the shape of the dial.

8. The attachable bedside urinal holder of claim 7, wherein the magnet and the dial are circular in shape.

* * * * *